US012292226B2

(12) United States Patent
Yoshikawa et al.

(10) Patent No.: US 12,292,226 B2
(45) Date of Patent: May 6, 2025

(54) DEFROST SYSTEM WHICH UTILIZES ELECTRIC HEATER FOR THERMOSIPHON

(71) Applicant: MAYEKAWA MFG. CO., LTD., Tokyo (JP)

(72) Inventors: Choiku Yoshikawa, Tokyo (JP); Toshio Kutsuna, Tokyo (JP); Nelson Mugabi, Tokyo (JP); Daiki Kayashima, Tokyo (JP); Nobuo Oosuga, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 200 days.

(21) Appl. No.: 18/145,963

(22) Filed: Dec. 23, 2022

(65) Prior Publication Data

US 2023/0127825 A1 Apr. 27, 2023

Related U.S. Application Data

(63) Continuation of application No. 16/982,326, filed as application No. PCT/JP2019/028629 on Jul. 22, 2019, now abandoned.

(51) Int. Cl.
*F25D 21/08* (2006.01)
*F25B 25/00* (2006.01)
(Continued)

(52) U.S. Cl.
CPC ..... *F25D 21/08* (2013.01); *F25B 25/005* (2013.01); *F25B 41/00* (2013.01); *F25B 41/20* (2021.01);
(Continued)

(58) Field of Classification Search
CPC ..... F25D 21/002; F25D 21/08
See application file for complete search history.

(56) References Cited

U.S. PATENT DOCUMENTS 2,348,784 A 5/1944 Carl
3,922,874 A * 12/1975 Canter ..... F25D 21/002 62/155
(Continued)

FOREIGN PATENT DOCUMENTS

CN 1916539 A 2/2007
CN 105283719 A 1/2016
(Continued)

OTHER PUBLICATIONS

International Search Report and Written Opinion issued in corresponding International Patent Application No. PCT/JP2019/028629, 10 pages (Sep. 10, 2019).
(Continued)

*Primary Examiner* — Jerry-Daryl Fletcher
*Assistant Examiner* — Daniel C Comings
(74) *Attorney, Agent, or Firm* — BUCHANAN INGERSOLL & ROONEY PC

(57) ABSTRACT

A defrost system includes a thermosiphon defrost circuit that is provided by being branched from a circulation line, in which, at the time of defrosting, a $CO_2$ refrigerant staying inside a fin-tube heat exchanger repeats a two-phase change of a gaseous form and reliquefaction, and which forms a $CO_2$ circulation path together with the fin-tube heat exchanger; electromagnetic opening/closing valves that are closed at the time of defrosting and set the $CO_2$ circulation path to a closed circuit; and a first electric heater arranged above the thermosiphon defrost circuit so as to be adjacent to the thermosiphon defrost circuit, and naturally circulates the $CO_2$ refrigerant in the closed circuit at the time of defrosting.

18 Claims, 6 Drawing Sheets

(51) Int. Cl.

| | |
|---|---|
| ***F25B 41/00*** | (2021.01) |
| ***F25B 41/20*** | (2021.01) |
| ***F25B 47/02*** | (2006.01) |
| ***F25D 17/02*** | (2006.01) |
| ***F25D 21/00*** | (2006.01) |
| *F25B 7/00* | (2006.01) |
| *F25D 21/14* | (2006.01) |

(52) U.S. Cl.

CPC ..... *F25B 47/02* (2013.01); *F25D 17/02* (2013.01); *F25D 21/002* (2013.01); *F25B 7/00* (2013.01); *F25B 2309/06* (2013.01); *F25B 2400/01* (2013.01); *F25B 2600/2525* (2013.01); *F25D 21/14* (2013.01)

(56) References Cited

U.S. PATENT DOCUMENTS

| | | | | |
|---|---|---|---|---|
| 4,932,217 | A * | 6/1990 | Meyer | F25D 21/002 62/155 |
| 7,028,499 | B2 | 4/2006 | Kwon et al. | |
| 2004/0159121 | A1 | 8/2004 | Horiuchi et al. | |
| 2004/0195344 | A1* | 10/2004 | Isaacson | B60H 1/00271 237/12.3 B |
| 2007/0028626 | A1 | 2/2007 | Chen | |
| 2008/0041092 | A1* | 2/2008 | Gorbounov | F28D 1/0476 165/178 |
| 2011/0056668 | A1 | 3/2011 | Taras et al. | |
| 2015/0377541 | A1* | 12/2015 | Yoshikawa | F25B 49/02 62/140 |
| 2019/0072311 | A1 | 3/2019 | Jensen | |
| 2020/0080763 | A1* | 3/2020 | Kang | F28F 17/00 |
| 2021/0262721 | A1 | 8/2021 | Yoshikawa et al. | |

FOREIGN PATENT DOCUMENTS

| | | | | |
|---|---|---|---|---|
| CN | 105283720 | A | 1/2016 | |
| CN | 108603712 | A | 9/2018 | |
| JP | S6213977 | A | 1/1987 | |
| JP | H02197786 | A | 8/1990 | |
| JP | H05306877 | A | 11/1993 | |
| JP | 2000121233 | A | 4/2000 | |
| JP | 2002243350 | A | 8/2002 | |
| JP | 3404299 | B2 | 5/2003 | |
| JP | 2010060177 | A | 3/2010 | |
| JP | 2013124812 | A | 6/2013 | |
| JP | 2015093233 | A | 5/2015 | |
| KR | 101823809 | B1 | 1/2018 | |
| WO | 2015093233 | A1 | 6/2015 | |
| WO | WO-2018216858 | A1 * | 11/2018 | F25D 21/004 |

OTHER PUBLICATIONS

Office Action (Notice of First Office Action) issued Aug. 3, 2022, by the State Intellectual Property Office of People's Republic of China in corresponding Chinese Patent Application No. 201980094882.3 and an English Translation of the Office Action. (19 pages).

Office Action (Notification of Reason for Refusal) issued Nov. 22, 2021, by the Korean Intellectual Property Office in corresponding Korean Patent Application No. 10-2020-7024869 and an English Translation of the Office Action. (10 pages).

The extended European Search Report issued Jul. 13, 2022, by the European Patent Office in corresponding European Patent Application No. 19917556.3-1016. (9 pages).

Office Action (Notification of Reasons for Refusal) issued Apr. 20, 2021, by the Japanese Patent Office in corresponding Japanese Patent Application No. 2020-547245 and an English Translation of the Office Action. (9 pages).

Office Action (Communication pursuant to Article 94(3) EPC) issued Mar. 10, 2023, by the European Patent Office in corresponding European Patent Application No. 19 917 556.3-1016. (5 pages).

Office Action (Notice of Second Office Action) issued Mar. 27, 2023, by the State Intellectual Property Office of People's Republic of China in corresponding Chinese Patent Application No. 201980094882.3 and an English translation of the Office Action. (21 pages).

* cited by examiner

DEFROST SYSTEM WHICH UTILIZES ELECTRIC HEATER FOR THERMOSIPHON

CROSS REFERENCE TO RELATED APPLICATIONS

This application is a continuation of U.S. patent application Ser. No. 16/982,326 filed Sep. 18, 2020, which is a U.S. national stage application based on International Patent Application No. PCT/JP2019/028629 filed Jul. 22, 2019, the entire content of both of which is incorporated herein by reference.

TECHNICAL FIELD

The present invention relates to a defrost system applied to a refrigeration apparatus that cools the interior of a cold storage room by circulating a $CO_2$ refrigerant in a cooler provided in the cold storage room, and for removing frost attached to a fin-tube heat exchanger provided in the cooler.

BACKGROUND ART

From the viewpoint of preventing ozone layer depletion, preventing global warming, and the like, a refrigeration apparatus in which, as a refrigerant of a refrigeration apparatus used for indoor air conditioning, refrigeration of food, and the like, ammonia that has high cooling performance but is toxic is used as a primary refrigerant and $CO_2$ that is non-toxic and odorless is used as a secondary refrigerant has widely been used.

In such a refrigeration apparatus, a primary refrigerant circuit in which ammonia refrigerant circulates and a secondary refrigerant circuit in which $CO_2$ refrigerant circulates are connected by a cascade condenser, and heat is transferred between the ammonia refrigerant and the $CO_2$ refrigerant in the cascade condenser. The $CO_2$ refrigerant cooled and liquefied by the ammonia refrigerant is sent to the cooler provided inside the cold storage room, and cools the air inside the cold storage room via the fin-tube heat exchanger provided inside the casing of the cooler. The $CO_2$ refrigerant partially vaporized by cooling the air in the cold storage room returns to a $CO_2$ receiver via the secondary refrigerant circuit and is again cooled and liquefied by the cascade condenser.

During operation of the refrigeration apparatus, frost forms on the heat exchange tube provided in the cooler and reduces the heat transfer efficiency, and therefore it is necessary to perform defrosting (frost removal).

In this regard, for example, in Patent Literature 1 below, a defrost system in which a defrost circuit (thermosiphon defrost circuit) and a warm brine circuit are installed and which includes a first heat exchanger for heating a $CO_2$ refrigerant circulating in the defrost circuit with warm brine is disclosed. With the defrost system configured as described above, a $CO_2$ refrigerant liquid in a closed circuit drops by gravity to the first heat exchanger in the defrost circuit, and is heated and vaporized by the warm brine in the first heat exchanger. The vaporized $CO_2$ refrigerant rises in the defrost circuit by the thermosiphon effect, and the risen $CO_2$ refrigerant gas heats and melts the frost attached to the outer surface of the fin-tube heat exchanger provided inside the cooler. The $CO_2$ refrigerant that is liquefied by heating the fin-tube heat exchanger descends in the defrost circuit by gravity. The $CO_2$ refrigerant liquid that has descended to the first heat exchanger is again heated and vaporized in the first heat exchanger.

CITATION LIST

Patent Literatures

Patent Literature 1: JP 2015/093233 X

SUMMARY

In the defrost system disclosed in Patent Literature 1, since the warm brine circuit is installed, a warm brine facility becomes bulky and the concentration control of the warm brine is required.

On the other hand, it is important to prevent icicles from forming in the lower part of the cooler by melting water flowing from the upper part of the cooler during defrosting.

The present invention was invented to solve the above problems, and an object is to provide a defrost system capable of preferable defrosting of a cooler and preventing icicles from being generated in a fin-tube heat exchanger at a lower part of a casing without having to install a warm brine circuit for heating a thermosiphon defrost circuit.

According to one aspect, a refrigeration apparatus comprises: a cold storage room; a cooler located in the cold storage room, wherein the cooler includes a casing and a fin-tube heat exchanger, with the fin-tube heat exchanger being positioned inside the casing; a drain pan located in the cold storage room at a position below the fin-tube heat exchanger; a circulation line connected to the fin-tube heat exchanger and configured to circulate a $CO_2$ refrigerant having a low temperature at a time of cooling; a refrigeration cycle that cools and reliquefies the $CO_2$ refrigerant in a gaseous form with a refrigerant that circulates inside the refrigeration cycle; and a defrost system positioned inside the cold storage room and outside the cooler to melt and remove frost attached to an outer surface of the fin-tube heat exchanger during defrosting. The defrost system comprises a thermosiphon defrost circuit that forms a $CO_2$ circulation path together with the fin-tube heat exchanger, wherein the thermosiphon defrost circuit branches from the circulation line so that during the defrosting the $CO_2$ refrigerant staying inside the fin-tube heat exchanger repeats a two-phase change of a gaseous form and reliquefaction. The defrost system also comprises an opening/closing valve that is closed during the defrosting and that sets the $CO_2$ circulation path to a closed circuit in which the $CO_2$ refrigerant is naturally circulated during the defrosting. The thermosiphon defrost circuit includes a first line branching from the circulation line of the $CO_2$ refrigerant; a first header to which an end of the first line is connected, with the first header to which the end of the first line is connected including first and second parts that are spaced apart from one another; and a second header provided at a position higher than the first header, the second header including first and second parts that are spaced apart from one another. The first part of the first header and the first part of the second header are closest parts of the first and second headers, the second part of the first header and the second part of the second header are most distant parts of the first and second headers, and a straight line distance between the closest parts of the first and second headers is less than a straight line distance between the most distant parts of the first and second headers. Plural second lines extend between and communicate the first and second headers, and the plural second lines include a line connecting the most distant parts of the first header and the second header in a meander shape, and a line connecting the closest parts of the first header and the second header in a meander shape. The thermosiphon defrost circuit also includes a third line that is connected to and communicates with both the second header and the circulation line, and an electric heater positioned inside the cold storage room and outside the casing. The electric heater is positioned above all of the plural second lines that extend between and communicate the first and second headers, and the electric heater is configured to heat and vaporize the $CO_2$ refrigerant liquid in the plural second lines of the closed circuit during the defrosting so that the $CO_2$ refrigerant liquid that is vaporized rises in the thermosiphon defrost circuit by the principle of thermosiphon.

With the defrost system configured as described above, the $CO_2$ refrigerant liquid in the closed circuit drops by gravity to the first electric heater in the thermosiphon defrost circuit, and is heated and vaporized by the first electric heater. The vaporized $CO_2$ refrigerant rises in the thermosiphon defrost circuit by the principle of thermosiphon, and the risen $CO_2$ refrigerant gas heats the fin-tube heat exchanger provided inside the cooler, and heats and melts the frost attached to the outer surface of the fin-tube heat exchanger. The $CO_2$ refrigerant that is liquefied by heating the fin-tube heat exchanger descends in the thermosiphon defrost circuit by gravity. The $CO_2$ refrigerant liquid that has descended to the first electric heater is heated and vaporized again by the first electric heater. From the above, it is possible to preferably perform defrosting of a cooler and prevent icicles from being generated in a fin-tube heat exchanger at a lower part of a casing without having to install a warm brine circuit for heating a thermosiphon defrost circuit.

According to another aspect, a refrigeration apparatus comprises a cold storage room and a cooler located in the cold storage room, wherein the cooler includes a casing and a heat exchanger, and the heat exchanger is positioned inside the casing. The heat exchanger comprises plural heat exchange tubes through which $CO_2$ refrigerant flows, wherein the plural heat exchange tubes each have a lower end and an upper end, with the lower end of each of the plural heat exchange tubes being coupled to a lower header and the upper end of each of the plural heat exchange tubes being coupled to an upper header, and the upper header being positioned vertically above the lower header. The refrigeration apparatus also comprises: a drain pan located in the cold storage room at a position below the heat exchanger; a circulation line connected to the heat exchanger and configured to circulate a $CO_2$ refrigerant having a low temperature at a time of cooling; a refrigeration cycle that cools and reliquefies the $CO_2$ refrigerant in a gaseous form with a refrigerant that circulates inside the refrigeration cycle; and a defrost system positioned inside the cold storage room and outside the cooler to melt and remove frost attached to an outer surface of the heat exchanger during defrosting. The defrost system comprises: a thermosiphon defrost circuit that forms a $CO_2$ circulation path together with the heat exchanger, with the thermosiphon defrost circuit branching from the circulation line so that during the defrosting the $CO_2$ refrigerant staying inside the heat exchanger repeats a two-phase change of a gaseous form and reliquefaction. The defrost system also includes an opening/closing valve that is closed during the defrosting and that sets the $CO_2$ circulation path to a closed circuit in which the $CO_2$ refrigerant is naturally circulated during the defrosting. The thermosiphon defrost circuit includes: a first line branching from the circulation line of the $CO_2$ refrigerant; a first header to which an end of the first line is connected, with the first header to which the end of the first line is connected including first and second parts that are spaced apart from one another, and the first line providing communication between the first header of the thermosiphon defrost circuit and the lower header of the heat exchanger so that the $CO_2$ refrigerant that has entered the lower header after flowing through the plural heat exchange tubes flows toward the first header; and a second header provided at a position higher than the first header, the second header including first and second parts that are spaced apart from one another. The first part of the first header and the first part of the second header are closest parts of the first and second headers, the second part of the first header and the second part of the second header are most distant parts of the first and second headers, and a straight line distance between the closest parts of the first and second headers is less than a straight line distance between the most distant parts of the first and second headers. The thermosiphon defrost circuit also includes plural second lines that extend between and communicate the first and second headers, wherein the plural second lines include a line connecting the most distant parts of the first header and the second header in a meander shape, and a line connecting the closest parts of the first header and the second header in a meander shape. The thermosiphon defrost circuit further includes a third line that provides communication between the second header of the thermosiphon defrost circuit and the upper header of the heat exchanger, and an electric heater positioned inside the cold storage room and outside the casing, the electric heater positioned above all of the second lines that extend between and communicate the first and second headers. The electric heater is configured to heat and vaporize the $CO_2$ refrigerant liquid in the second lines during the defrosting and without a brine circuit so that the $CO_2$ refrigerant liquid that is vaporized rises in the thermosiphon defrost circuit by the principle of thermosiphon.

DESCRIPTION OF EMBODIMENTS

Figure 1:
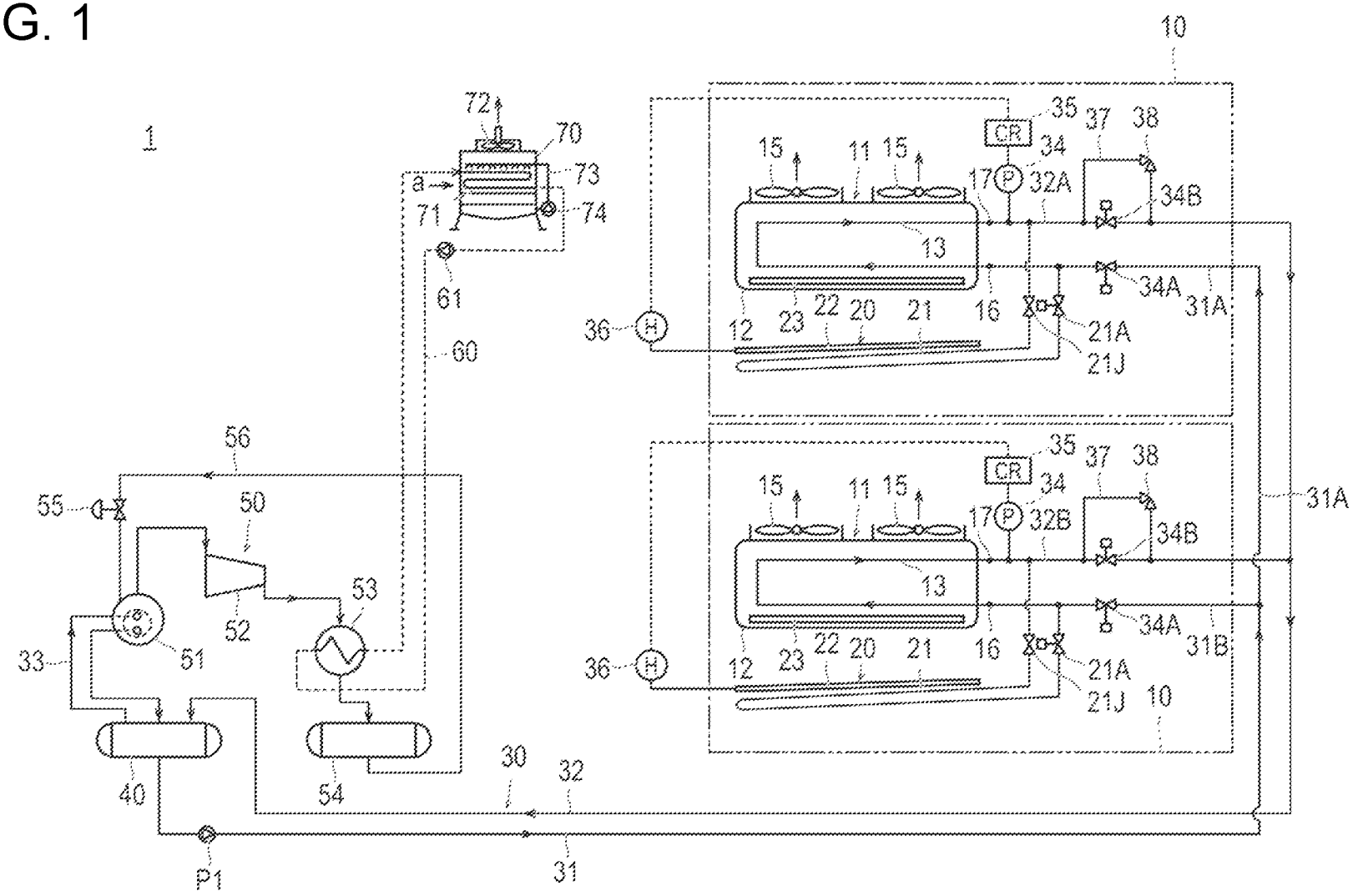
FIG. 1 is an overall configuration diagram of a refrigeration apparatus according to the present embodiment.

An embodiment of the present invention will be described with reference to FIGS. 1 to 6. Note that, in the description of the drawings, the same elements will be denoted by the same reference symbols, and redundant description will be omitted. The dimensional ratios in the drawings are exaggerated for the sake of convenience of description, and may differ from the actual ratios.

Figure 2:
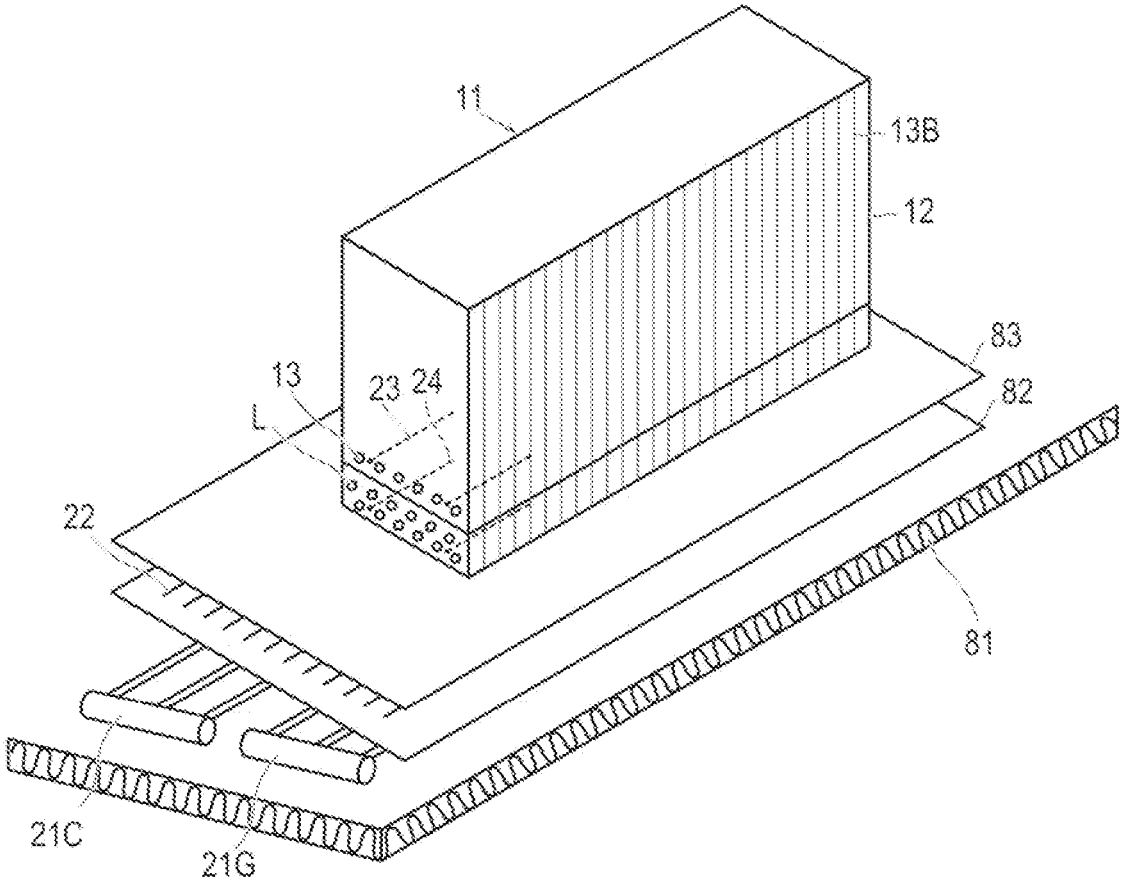
FIG. 2 is a schematic perspective view of a cooler, a defrost system, and the like according to the present embodiment.
Figure 3:
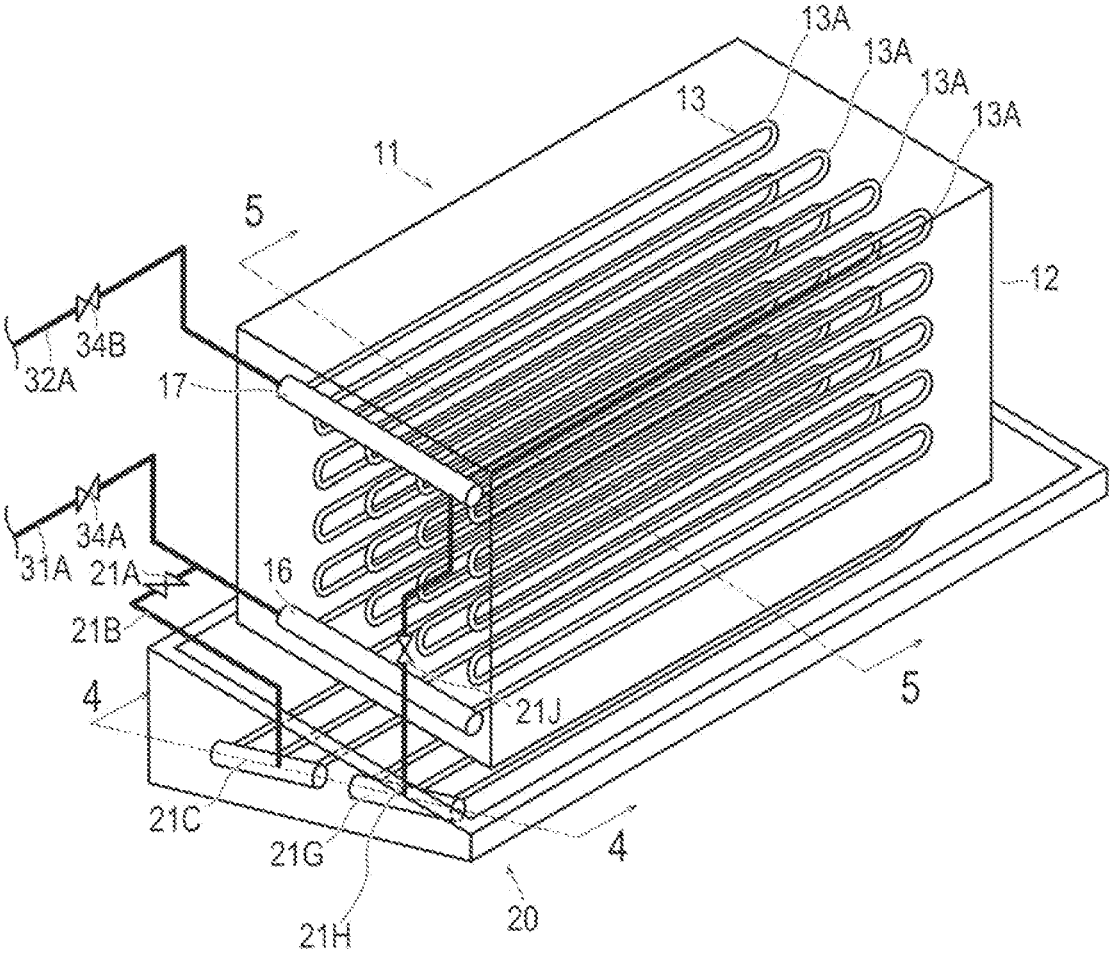
FIG. 3 is a schematic diagram of a cooler and a defrost system according to the present embodiment.
Figure 4:
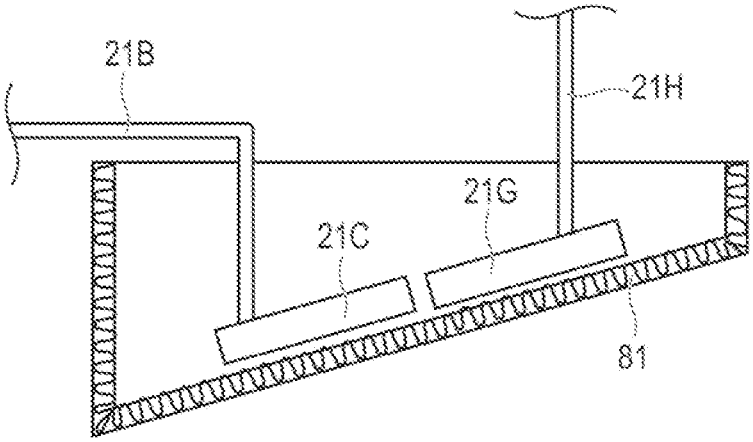
FIG. 4 is a sectional view taken along section line 4-4 in FIG. 3.
Figure 5:
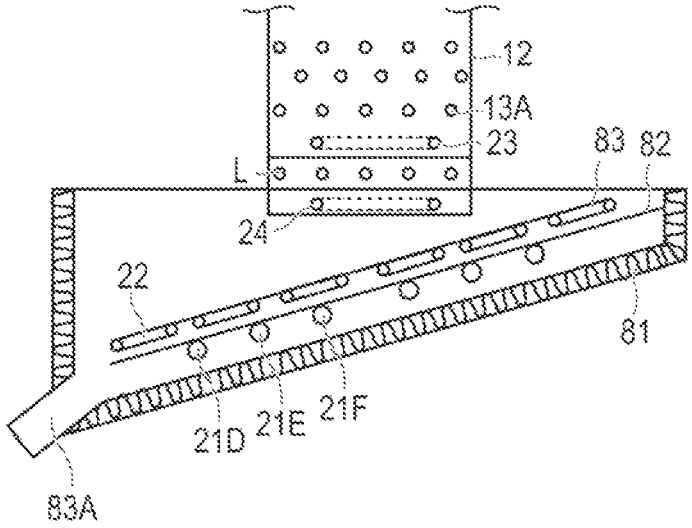
FIG. 5 is a sectional view taken along section line 5-5 in FIG. 3.
Figure 6:
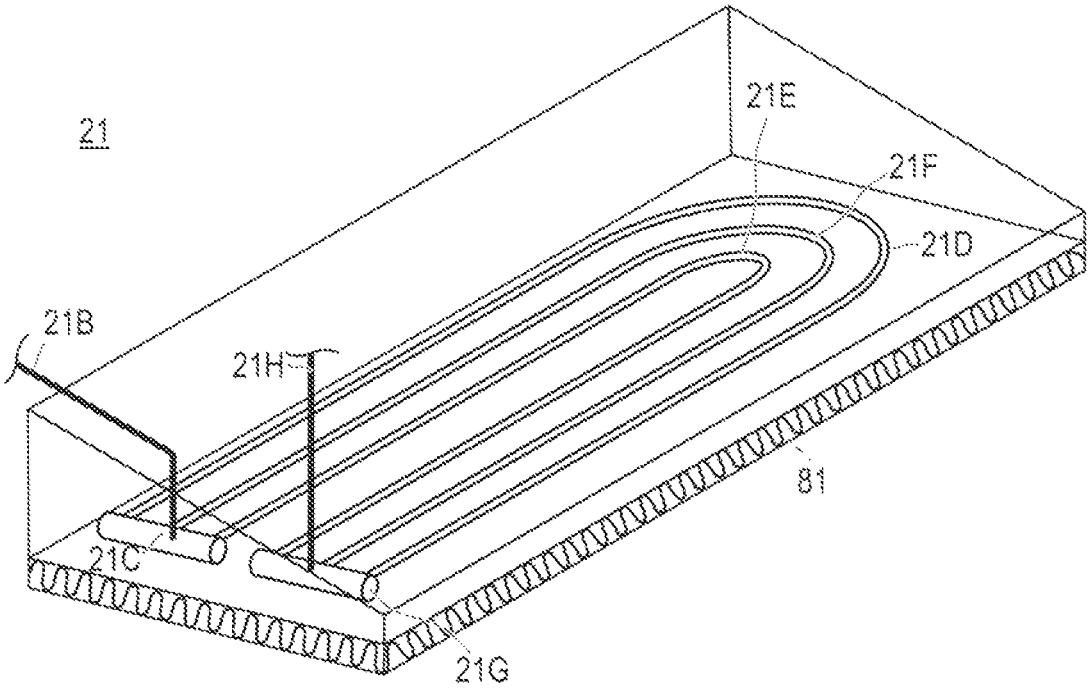
FIG. 6 is a schematic diagram showing a thermosiphon defrost circuit according to the present embodiment.

FIG. 1 is an overall configuration diagram of a refrigeration apparatus 1 according to the present embodiment. FIG. 2 is a schematic perspective view of a cooler 11, a defrost system 20, and the like according to the present embodiment. FIG. 3 is a schematic diagram of the cooler 11 and the defrost system 20 according to the present embodiment. FIG. 4 is a sectional view taken along line 4-4 in FIG. 3. FIG. 5 is a sectional view taken along line 5-5 in FIG. 3. FIG. 6 is a schematic diagram showing a thermosiphon defrost circuit 21 according to the present embodiment.

As shown in FIG. 1, a refrigeration apparatus 1 includes a pair of coolers 11 provided in a cold storage room 10, a defrost system 20 provided in the cooler 11, a circulation line (secondary refrigerant circuit) 30 through which a $CO_2$ refrigerant circulates, a $CO_2$ receiver 40 for storing the $CO_2$ refrigerant, an ammonia refrigeration cycle 50 (refrigeration cycle) including a circulation line (primary refrigerant circuit) 56 in which an ammonia refrigerant circulates, a cooling water circuit 60 in which cooling water circulates, and a closed cooling tower 70 connected to the cooling water circuit 60.

In the cold storage room 10, as shown in FIG. 1, two coolers 11 are provided vertically. Since the configurations of the two coolers 11 are the mutually same configuration, and therefore the configuration of one cooler 11 will be described here.

As shown in FIG. 1, the cooler 11 includes a casing 12, a fin-tube heat exchanger 13 provided inside the casing 12, and a fan 15 that forms an airflow that flows in and out of the casing 12.

As shown in FIG. 2, the casing 12 is configured in a substantially rectangular shape. Inside the casing 12, the fin-tube heat exchanger 13 is arranged. Further, a second electric heater 23 is arranged below the lowermost part of the fin-tube heat exchanger 13, and a third electric heater 24 is arranged below a dummy pipe L provided at the lowermost part of the casing 12. The second electric heater 23 and the third electric heater 24 constitute a lower electric heater. The dummy pipe L is provided to prevent bridges due to icicles of a drain pan 83 to be described below and a heat exchange tube 13A of the fin-tube heat exchanger 13 and to ensure a uniform front wind speed, and the $CO_2$ refrigerant does not circulate.

The fin-tube heat exchanger 13 includes the heat exchange tube 13A and fins 13B as shown in FIGS. 2 and 3. As shown in FIG. 3, the heat exchange tube 13A is formed in a meander shape in a vertical direction and in a horizontal direction inside the casing 12. The fin 13B is formed in the vertical direction as shown in FIG. 2. Further, as shown in FIG. 3, four heat exchange tubes 13A are provided along a depth direction of the casing 12. Note that the configuration of the heat exchange tube 13A is not limited thereto as long as it is evenly arranged inside the casing 12.

As shown in FIG. 3, the four heat exchange tubes 13A are coupled to an inlet header 16 at a lower end of the four heat exchange tubes 13A. Further, as shown in FIG. 3, the four heat exchange tubes 13A are coupled to an outlet header 17 at an upper end of the four heat exchange tubes 13A.

The fan 15 is arranged above the casing 12 as shown in FIG. 1. Note that the position where the fan 15 is provided may be a side surface of the casing 12, or the like. When the fan 15 operates, an airflow that flows in and out of the casing 12 is formed.

The defrost system 20 is provided for melting and removing (defrosting) frost attached to a surface of the fin-tube heat exchanger 13. As shown in FIGS. 1 to 5, the defrost system 20 includes the thermosiphon defrost circuit 21, a first electric heater 22, the second electric heater 23, and the third electric heater 24.

As shown in FIG. 1, the thermosiphon defrost circuit 21 is provided by being branched from a $CO_2$ feed line 31 of the circulation line 30, and forms a $CO_2$ circulation path together with the fin-tube heat exchanger 13. Further, a heat collection portion of the thermosiphon defrost circuit 21 is arranged below the first electric heater 22.

As shown in FIGS. 1 and 3, in the thermosiphon defrost circuit 21, an electromagnetic opening/closing valve 21A and a check valve 21J are arranged. At the time of defrosting, the thermosiphon defrost circuit 21 closes electromagnetic opening/closing valves 34A and 34B, which will be described below, and opens the electromagnetic opening/closing valve 21A to form the $CO_2$ circulation path through which $CO_2$ circulates. On the other hand, the thermosiphon defrost circuit 21 opens the electromagnetic opening/closing valves 34A and 34B and closes the electromagnetic opening/closing valve 21A at the time of a refrigerating operation.

The configuration of the thermosiphon defrost circuit 21 will be described below in detail with reference to FIGS. 3 and 6.

As shown in FIGS. 3 and 6, the thermosiphon defrost circuit 21 includes a first line 21B branched from the $CO_2$ feed line 31 of the circulation line 30, a first header 21C to which an end of the first line 21B is connected, three second lines 21D, 21E, 21F extending from the first header 21C, a second header 21G to which the three second lines 21D, 21E, 21F are coupled and which is provided at a position higher than the first header 21C, and a third line 21H extending from the second header 21G and connected to a $CO_2$ return line 32 of the circulation line 30.

The three second lines 21D, 21E, 21F, as shown in FIG. 6, include the second line 21D connecting the most distant parts of the first header 21C and the second header 21G in a meander shape, the second line 21E connecting the closest parts of the first header 21C and the second header 21G in a meander shape, and the second line 21F arranged between the second line 21D and the second line 21E. With this configuration, the three second lines 21D, 21E, 21F are arranged in an upward inclination without crossing each other, and therefore, in the three second lines 21D, 21E, 21F, $CO_2$ can be circulated preferably.

As shown in FIGS. 1, 2, and 5, the first electric heater 22 is arranged below the drain pan 83 described below and above the three second lines 21D, 21E, 21F. As shown in FIG. 2, the first electric heater 22 is configured such that six heaters have a U shape. The output per heater is not particularly limited, but is 1.5 kW.

The second electric heater 23 is, as shown in FIGS. 1, 2, and 5, arranged below the fin-tube heat exchanger 13 inside the casing 12. Specifically, as shown in FIG. 5, the second electric heater 23 is arranged below the heat exchange tube 13A and above the dummy pipe L. The output of one heater is not particularly limited, but is 1.5 kW. Since the second electric heater 23 is arranged below the fin-tube heat exchanger 13 inside the casing 12 as described above, water droplets descending the fin-tube heat exchanger 13 can be recovered by the drain pan 83 without being refrozen to be icicles at the fin-tube heat exchanger 13 at a lower part of the casing 12.

The third electric heater 24 is, as shown in FIG. 5, arranged below the dummy pipe L. That is, the third electric heater 24 is arranged at the lowermost part inside the casing 12. Since the third electric heater 24 is arranged at the lowermost part inside the casing 12, it is possible to preferably prevent refreezing at a lower part of the casing 12 to generate icicles.

As shown in FIGS. 2 and 5, a heat insulating material 81 is provided below the thermosiphon defrost circuit 21. The thickness of the heat insulating material 81 is not particularly limited, but is, for example, 20 mm, and prevents heat radiation loss from the lower surface of the thermosiphon defrost circuit 21 heated by the first electric heater 22. The drain pan 83 is provided above the first electric heater 22, and water droplets at the time of defrosting can be drained from a drain discharge pipe 83A without refreezing. Further, between the thermosiphon defrost circuit 21 and the first electric heater 22, a heat transfer plate 82 is provided. By providing the heat transfer plate 82 in this way, the heat of the first electric heater 22 can be appropriately transferred to the heating of the $CO_2$ refrigerant.

The circulation line 30 is configured to circulate the $CO_2$ refrigerant. The circulation line 30, as shown in FIG. 1, includes the $CO_2$ feed line 31 for feeding the $CO_2$ refrigerant in a liquid form to the pair of cold storage rooms 10 from the $CO_2$ receiver 40, the $CO_2$ return line 32 for returning a gas-liquid mixed $CO_2$ refrigerant coming out of the pair of cold storage rooms 10 to the $CO_2$ receiver 40, and a reliquefaction line 33 for reliquefying the gasified $CO_2$ refrigerant.

The $CO_2$ feed line 31 is, as shown in FIG. 1, connected to a lower part of the $CO_2$ receiver 40. Further, the $CO_2$ return line 32 is, as shown in FIG. 1, connected to an upper part of the $CO_2$ receiver 40.

Further, a first pump P1 is provided in the $CO_2$ feed line 31, and the $CO_2$ refrigerant in a liquid form in the $CO_2$ receiver 40 is fed to the cooler 11 in the cold storage room 10 by the first pump P1.

As shown in FIG. 1, the $CO_2$ feed line 31 is branched into a first feed line 31A connected to one cooler 11 and a second feed line 31B connected to the other cooler 11.

The first feed line 31A is connected to a first return line 32A via the one cooler 11. Further, the second feed line 31B is connected to a second return line 32B via the other cooler 11. The first return line 32A and the second return line 32B join again and are coupled to the $CO_2$ return line 32.

The first feed line 31A is, as shown in FIGS. 1 and 3, connected to the inlet header 16, and the first return line 32A is connected to the outlet header 17. As shown in FIG. 1, an electromagnetic opening/closing valve (opening/closing valve) 34A is arranged in the first feed line 31A, and an electromagnetic opening/closing valve (opening/closing valve) 34B is arranged in the first return line 32A.

As shown in FIG. 1, a pressure sensor 34 is connected to the first return line 32A. A control portion 35 to which a detection value of the pressure sensor 34 is input is connected to the pressure sensor 34. Further, a controller 36 of the first electric heater 22 is connected to the control portion 35, and the control portion 35 can control the temperature of the first electric heater 22 and ON/OFF of the six heaters.

At the time of defrosting, the control portion 35 can reduce the temperature of the first electric heater 22 or reduce the number of heaters of the first electric heater 22 among the six heaters to be turned on when the pressure of the $CO_2$ circulation path measured by the pressure sensor 34 is higher than a predetermined pressure.

Further, the first return line 32A is provided with a branch circuit 37 that branches from the first return line 32A, the branch circuit 37 is provided with a pressure adjusting valve 38, and when the pressure is higher than a predetermined pressure, the pressure adjusting valve 38 is opened to reduce the pressure.

The reliquefaction line 33 is connected an upper part of the $CO_2$ receiver 40. When passing through the reliquefaction line 33, the $CO_2$ refrigerant in a gaseous form in the $CO_2$ receiver 40 is reliquefied by a heat exchanger 51 of the ammonia refrigeration cycle 50 described below. Then, the reliquefied $CO_2$ refrigerant in a liquid form returns to the $CO_2$ receiver 40.

The ammonia refrigeration cycle 50 circulates the ammonia refrigerant. The ammonia refrigeration cycle 50 cools and liquefies the $CO_2$ refrigerant in a gaseous form. As shown in FIG. 1, the ammonia refrigeration cycle 50 includes the heat exchanger (cascade condenser) 51 as an evaporator, a refrigeration compressor 52, a condenser 53, an ammonia receiver 54, an expansion valve 55, and the circulation line (primary refrigerant circuit) 56 through which the ammonia refrigerant circulates.

The ammonia refrigerant gas evaporated by the heat of the $CO_2$ refrigerant in a gaseous form in the heat exchanger 51 is compressed by the refrigeration compressor 52, the high temperature and high pressure ammonia refrigerant gas is cooled and condensed in the condenser 53, the liquefied ammonia refrigerant liquid is stored in the ammonia receiver 54, the ammonia refrigerant liquid in the ammonia receiver 54 is fed to and expanded by the expansion valve 55, and the low-pressure ammonia refrigerant liquid is fed to the heat exchanger 51 and is used for cooling $CO_2$ refrigerant in a gaseous form.

The cooling water circuit 60 is installed on the condenser 53. The cooling water circulating in the cooling water circuit 60 is heated by the ammonia refrigerant in the condenser 53.

The cooling water circuit 60 is connected to the closed cooling tower 70. The cooling water is circulated in the cooling water circuit 60 by a cooling water pump 61. The cooling water that has absorbed the exhaust heat of the ammonia refrigerant in the condenser 53 comes into contact with the outside air and spray water in the closed cooling tower 70, and is cooled by the latent heat of vaporization of the spray water.

The closed cooling tower 70 includes a cooling coil 71 connected to the cooling water circuit 60, a fan 72 for ventilating outside air a through the cooling coil 71, a sprinkling pipe 73 and a pump 74 for spraying the cooling water on the cooling coil 71. A part of the cooling water sprayed from the sprinkling pipe 73 evaporates, and the latent heat of vaporization is used to cool the cooling water flowing through the cooling coil 71.

The configuration of the refrigeration apparatus 1 has been described heretofore. Next, with reference to FIGS. 1, 7, and 8, a method of using the refrigeration apparatus 1 according to the present embodiment will be described separately for the refrigerating operation and the defrosting.

Figure 8A:
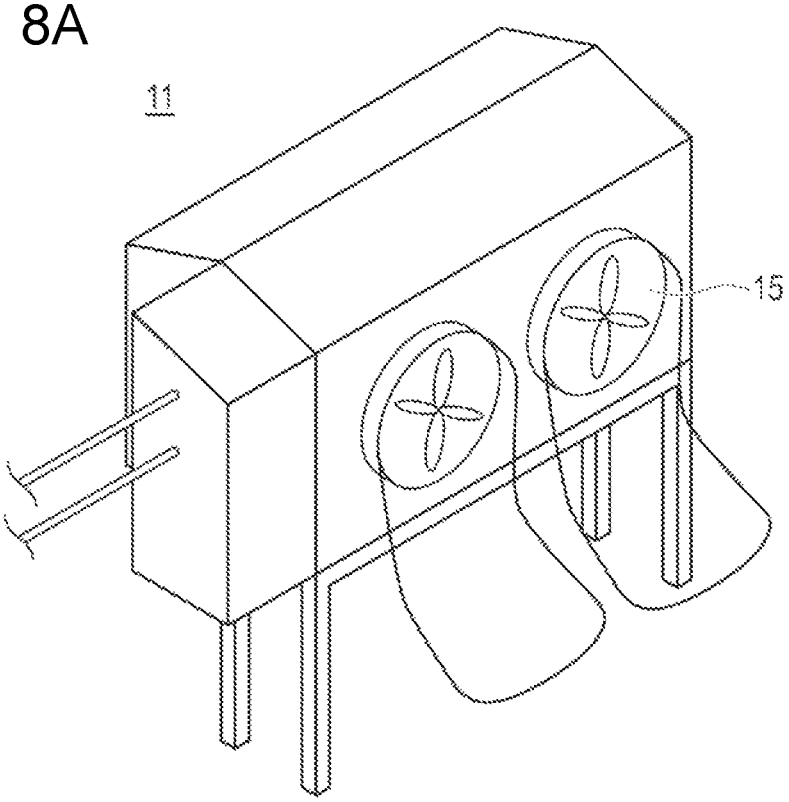
FIG. 8A is a diagram showing a state in which an opening of a fan is closed.
Figure 8B:
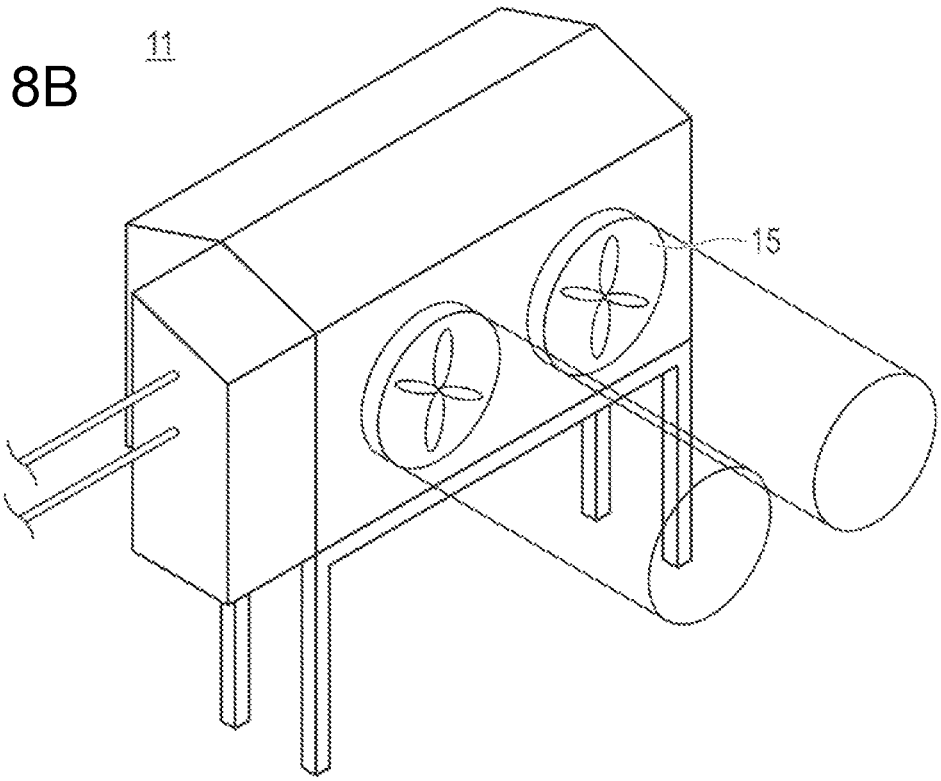
FIG. 8B is a diagram showing a state in which the opening of the fan is opened.

FIG. 1 is a diagram showing a circulation path of a $CO_2$ refrigerant at the time of a refrigerating operation. At the time of the refrigerating operation, the electromagnetic opening/closing valves 34A and 34B are opened and the electromagnetic opening/closing valve 21A is closed. Thus, the $CO_2$ refrigerant supplied from the $CO_2$ feed line 31 circulates through the first feed line 31A, the second feed line 31B, and the fin-tube heat exchanger 13. On the other hand, by the operation of the fan 15 inside the cold storage room 10, a circulating flow of the inside air passing through the inside of the cooler 11 is formed. The inside air is cooled by the $CO_2$ refrigerant circulating through the fin-tube heat exchanger 13, and the inside of the cold storage room 10 is kept at a low temperature of −25° C., for example. At the time of the refrigerating operation, as shown in FIG. 8B, the fan 15 is operated to open a sock duct.

Figure 7:
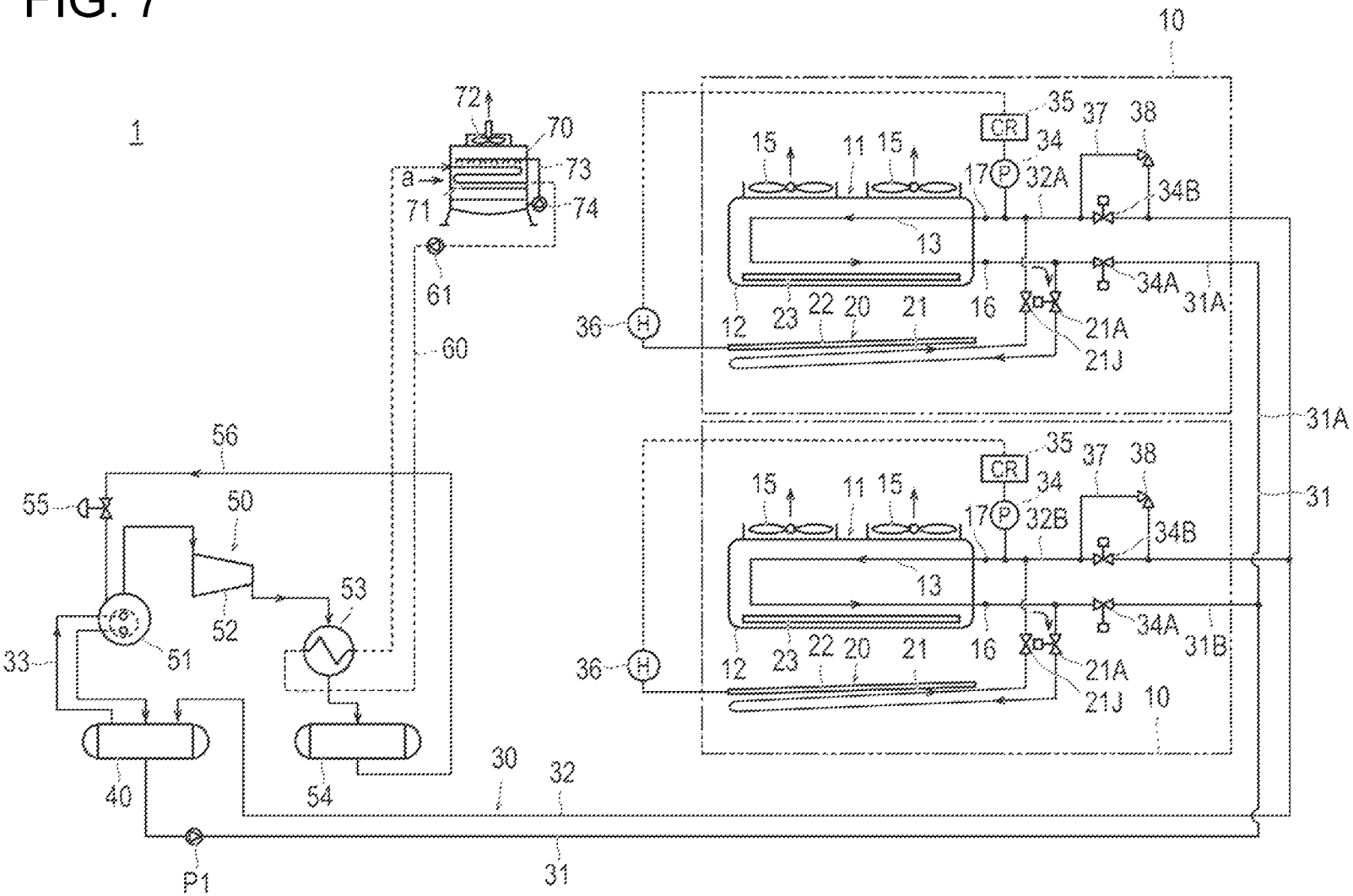
FIG. 7 is a diagram for explaining a circulation path of a $CO_2$ refrigerant at the time of defrosting.

FIG. 7 is a diagram showing a circulation path of a $CO_2$ refrigerant at the time of defrosting. At the time of defrosting, the electromagnetic opening/closing valves 34A and 34B are closed and the electromagnetic opening/closing valve 21A is opened. This forms a closed $CO_2$ circulation path including the fin-tube heat exchanger 13 and the thermosiphon defrost circuit 21.

The $CO_2$ refrigerant liquid in the closed circuit drops by gravity in the thermosiphon defrost circuit 21 to the first header 21C and the three second lines 21D, 21E, 21F extending from the first header 21C, is heated and vaporized by the first electric heater 22. The vaporized $CO_2$ refrigerant rises in the check valve 21J of the thermosiphon defrost circuit 21 by the principle of thermosiphon, and the risen $CO_2$ refrigerant gas heats and melts the frost attached to the outer surface of the fin-tube heat exchanger 13 provided inside the cooler 11. The $CO_2$ refrigerant that is liquefied by heating the fin-tube heat exchanger 13 descends in the thermosiphon defrost circuit 21 by gravity. The $CO_2$ refrigerant liquid that has descended to the first header 21C and the three second lines 21D, 21E, 21F extending from the first header 21C is again heated and vaporized by the first electric heater 22.

The melt water obtained as the frost is heated and melted falls toward the drain pan 83. At this time, for example, with the configuration in which the second electric heater 23 is not provided, there is a possibility that icicles are formed as refreezing occurs below the fin-tube heat exchanger 13. On the other hand, with the defrost system 20 according to the present embodiment, since the second electric heater 23 and the third electric heater 24 are provided at the lowermost part inside the casing 12, it is possible to prevent icicles from being formed below the casing 12. Further, at the time of defrosting, as shown in FIG. 8A, an opening of the fan 15 is closed by the sock duct to assist the temperature rise in the cooler 11 and prevent the generation of fog in the cold storage room 10. Note that the configuration in which the second electric heater 23 is not provided is also included in the present invention.

As described above, in the defrost system 20 of the refrigeration apparatus 1 according to the present embodiment, the cooler 11 including the casing 12, the fin-tube heat exchanger 13 provided inside the casing 12, and the drain pan 83 provided below the fin-tube heat exchanger 13 is provided inside the cold storage room 10. It is the defrost system 20 of the refrigeration apparatus 1 including the circulation line (secondary refrigerant circuit) 30 connected to the fin-tube heat exchanger 13 of the cooler 11 and in which a low-temperature $CO_2$ refrigerant circulates at the time of cooling, and the refrigeration cycle 50 that cools and reliquefies the $CO_2$ refrigerant in a gaseous form with a refrigerant circulating inside.

The defrost system 20 includes the thermosiphon defrost circuit 21 that is provided by being branched from the circulation line 30, in which, at the time of defrosting, the $CO_2$ refrigerant staying inside the fin-tube heat exchanger 13 repeats a two-phase change of a gaseous form and reliquefaction, and which forms a $CO_2$ circulation path together with the fin-tube heat exchanger 13; the opening/closing valves 34A and 34B that are closed at the time of defrosting and sets the $CO_2$ circulation path to a closed circuit; and the first electric heater 22 arranged above the thermosiphon defrost circuit 21 so as to be adjacent to the thermosiphon defrost circuit 21.

The $CO_2$ refrigerant is naturally circulated in the closed circuit at the time of defrosting. With the defrost system 20 configured in this way, the $CO_2$ refrigerant liquid in the closed circuit is heated and vaporized by the first electric heater 22, and rises in the thermosiphon defrost circuit 21 by the principle of thermosiphon, the risen $CO_2$ refrigerant gas heats the fin-tube heat exchanger 13 provided inside the cooler 11, and heats and melts the frost attached to the outer surface of the fin-tube heat exchanger 13. The $CO_2$ refrigerant that is liquefied by heating the fin-tube heat exchanger 13 descends in the thermosiphon defrost circuit 21 by gravity. The $CO_2$ refrigerant liquid that has descended to the first electric heater 22 is heated and vaporized by the first electric heater 22. Further, since the second electric heater 23 is provided at a lower part inside the casing 12, water droplets descending the fin-tube heat exchanger 13 can be recovered in the drain pan 83 without being refrozen to be icicles in the fin-tube heat exchanger 13 at a lower part of the casing 12. From the above, it is possible to preferably perform defrosting without installing a brine circuit, and it is possible to prevent the generation of icicles on the heat exchange tubes 13A and the fins 13B at a lower part of the casing 12.

Further, it includes the pressure sensor 34 for measuring the pressure of the $CO_2$ circulation path at the time of defrosting, and the control portion 35 that controls the first electric heater 22 such that the pressure of the $CO_2$ circulation path decreases when the measurement value measured by the pressure sensor 34 is higher than a predetermined pressure. With the defrost system 20 configured in this way, it is possible to prevent the pressure inside the thermosiphon defrost circuit 21 and the fin-tube heat exchanger 13 from becoming extremely high at the time of defrosting, and therefore it is possible to preferably prevent damage to the pipes of the thermosiphon defrost circuit 21 and the fin-tube heat exchanger 13.

Further, the thermosiphon defrost circuit 21 includes the first line 21B branched from the $CO_2$ feed line 31 of the circulation line 30 of the $CO_2$ refrigerant, the first header 21C to which an end of the first line 21B is connected, the three second lines 21D, 21E, 21F extending from the first header 21C, the second header 21G to which the three second lines 21D, 21E, 21F are connected and which is provided at a position higher than the first header 21C, and the third line 21H extending from the second header 21G and connected to the $CO_2$ return line 32 of the circulation line 30.

The three second lines 21D, 21E, 21F include the second line 21D connecting the most distant parts of the first header 21C and the second header 21G in a meander shape, the second line 21E connecting the closest parts of the first header 21C and the second header 21G in a meander shape, and the second line 21F arranged between the second line 21D and the second line 21E. With this configuration, because the three second lines 21D, 21E, 21F, which are arranged without crossing one another, can be preferably heated by the first electric heater 22 via the heat transfer plate 82, the $CO_2$ refrigerant can be naturally circulated.

With the defrost system 20 configured in this way, at the time of defrosting, it can be performed only by the first electric heater 22 that heats and naturally circulates the $CO_2$ refrigerant remaining in the pipes of the thermosiphon defrost circuit 21 and the fin-tube heat exchanger 13 and enables heating and draining of the drain pan 83 and the second electric heater 23 for preventing re-freezing at the fin-tube heat exchanger 13 at a lower part of the casing 12 (the third electric heater 24 if the dummy pipe L is present), and therefore it is possible to perform defrosting with very little electric power as compared with heater defrost in which heaters are evenly arranged in the arrangement of the fin-tube heat exchanger 13. Further, since the fin-tube heat exchanger 13 is directly heated, the delay in starting the defrosting can be eliminated.

Further, it further includes the branch circuit 37 provided by being branched from the circulation line 30, and on the branch circuit 37, the pressure adjusting valve 38 for reducing the pressure when the pressure in the circulation line 30 is higher than a predetermined pressure is arranged. With the defrost system 20 configured in this way, it is possible to prevent the pressure inside the thermosiphon defrost circuit 21 and the fin-tube heat exchanger 13 from becoming extremely high at the time of defrosting operation, and therefore it is possible to preferably prevent damage to the thermosiphon defrost circuit 21 and the fin-tube heat exchanger 13.

It should be noted that the present invention is not limited to the above-described embodiment, but can be variously modified within the scope of the claims.

For example, in the above-described embodiment, the thermosiphon defrost circuit 21 includes the first line 21B branched from the circulation line 30, the first header 21C to which an end of the first line 21B is connected, the three second lines 21D, 21E, 21F extending from the first header 21C, the second header 21G to which the three second lines 21D, 21E, 21F are coupled, and the third line 21H extending from the second header 21G and connected to the circulation line 30, but is not particularly limited as long as it is configured to form the $CO_2$ circulation path together with the fin-tube heat exchanger 13.

Further, in the above-described embodiment, the three second lines 21D, 21E, 21F are provided, but two or more may be provided.

Further, in the above-described embodiment, ammonia is used as the refrigerant of the refrigeration cycle, but it is not limited thereto, but chlorofluorocarbon or other natural refrigerants may be used.

Further, in the above-described embodiment, the two coolers 11 are provided, but one or three or more coolers 11 may be provided.

REFERENCE SIGNS LIST

1 refrigeration apparatus,
10 cold storage room,
11 cooler,
12 casing,
13 fin-tube heat exchanger,
13A heat exchange tube,
13B fin,
20 defrost system,
21 thermosiphon defrost circuit,
21A electromagnetic opening/closing valve,
21B first line,
21C first header,
21D, 21E, 21F second line,
21G second header,
21H third line,
21J check valve
22 first electric heater,
23 second electric heater,
30 circulation line,
34 pressure sensor,
34A, 34B electromagnetic opening/closing valve,
35 control portion,
37 branch circuit,
38 pressure adjusting valve,
83 drain pan.

The invention claimed is:

1. A refrigeration apparatus comprising:

a cold storage room;

a cooler located in the cold storage room, the cooler including a casing and a fin-tube heat exchanger, the fin-tube heat exchanger being positioned inside the casing;

a drain pan located in the cold storage room at a position below the fin-tube heat exchanger;

a circulation line connected to the fin-tube heat exchanger and configured to circulate a $CO_2$ refrigerant;

a refrigeration cycle that cools and reliquefies the $CO_2$ refrigerant in a gaseous form with a refrigerant that circulates inside the refrigeration cycle;

a defrost system positioned inside the cold storage room and outside the cooler to melt and remove frost attached to an outer surface of the fin-tube heat exchanger during defrosting, the defrost system comprising:

a thermosiphon defrost circuit that forms a $CO_2$ circulation path together with the fin-tube heat exchanger, the thermosiphon defrost circuit branching from the circulation line so that during the defrosting, the $CO_2$ refrigerant staying inside the fin-tube heat exchanger repeats a two-phase change of a gaseous form and reliquefaction;

an opening/closing valve that is closed during the defrosting and that sets the $CO_2$ circulation path to a closed circuit in which the $CO_2$ refrigerant is naturally circulated during the defrosting;

the thermosiphon defrost circuit including:

a first line branching from the circulation line of the $CO_2$ refrigerant;

a first header to which an end of the first line is connected, the first header to which the end of the first line is connected including first and second parts that are spaced apart from one another;

a second header provided at a position higher than the first header, the second header including first and second parts that are spaced apart from one another;

the first part of the first header and the first part of the second header being closest parts of the first and second headers, the second part of the first header and the second part of the second header being most distant parts of the first and second headers, a straight line distance between the closest parts of the first and second headers being less than a straight line distance between the most distant parts of the first and second headers;

plural second lines that extend between and communicate the first and second headers, the plural second lines including a line connecting the most distant parts of the first header and the second header in a meander shape, and a line connecting the closest parts of the first header and the second header in a meander shape;

a third line that is connected to and communicates with both the second header and the circulation line; and an electric heater positioned inside the cold storage room and outside the casing, the electric heater being positioned above all of the plural second lines that extend between and communicate the first and second headers, the electric heater being configured to heat and vaporize the $CO_2$ refrigerant liquid in the plural second lines of the closed circuit during the defrosting so that the $CO_2$ refrigerant liquid that is vaporized rises in the thermosiphon defrost circuit by the principle of thermosiphon.

2. The refrigeration apparatus according to claim 1, comprising:

a pressure sensor that measures a pressure of the $CO_2$ circulation path during the defrosting; and a control portion that controls the electric heater to decrease a pressure in the $CO_2$ circulation path when a pressure measured by the pressure sensor is higher than a predetermined pressure.

3. The refrigeration apparatus according to claim 1, wherein the electric heater is a first electric heater, and further comprising a second electric heater positioned in the casing at a lower part of the casing.

4. The refrigeration apparatus according to claim 1, further comprising a branch circuit that branches from the circulation line, and a pressure adjusting valve located in the branch circuit to reduce pressure when the pressure in the circulation line is higher than a predetermined pressure.

5. The refrigeration apparatus according to claim 1, further comprising heat insulating material positioned below the plural second lines that extend between and communicate the first and second headers so that the plural second lines are positioned between the heat insulating material and the electric heater.

6. The refrigeration apparatus according to claim 5, wherein the electric heater is positioned between the drain pan and the plural second lines that extend between and communicate the first and second headers.

7. The refrigeration apparatus according to claim 6, wherein the electric heater is a first electric heater, and further comprising a second electric heater positioned in the casing at a lower part of the casing, the second electric heater being located above the first electric heater.

8. The refrigeration apparatus according to claim 7, further comprising a heat transfer plate positioned between the first electric heater and the plural second lines that extend between and communicate the first and second headers to transfer heat produced by the first electric heater to the $CO_2$ refrigerant in the plural second lines.

9. The refrigeration apparatus according to claim 1, further comprising a heat transfer plate positioned between the electric heater and the plural second lines that extend between and communicate the first and second headers to transfer heat produced by the electric heater to the $CO_2$ refrigerant in the plural second lines.

10. A refrigeration apparatus comprising:

a cold storage room;

a cooler located in the cold storage room, the cooler including a casing and a heat exchanger, the heat exchanger being positioned inside the casing;

the heat exchanger comprising plural heat exchange tubes through which $CO_2$ refrigerant flows, the plural heat exchange tubes each having a lower end and an upper end, the lower end of each of the plural heat exchange tubes being coupled to a lower header and the upper end of each of the plural heat exchange tubes being coupled to an upper header, the upper header being positioned vertically above the lower header;

a drain pan located in the cold storage room at a position below the heat exchanger;

a circulation line connected to the heat exchanger and configured to circulate the $CO_2$ refrigerant;

a refrigeration cycle that cools and reliquefies the $CO_2$ refrigerant in a gaseous form with a refrigerant that circulates inside the refrigeration cycle;

a defrost system positioned inside the cold storage room and outside the cooler to melt and remove frost attached to an outer surface of the heat exchanger during defrosting, the defrost system comprising:

a thermosiphon defrost circuit that forms a $CO_2$ circulation path together with the heat exchanger, the thermosiphon defrost circuit branching from the circulation line so that during the defrosting, the $CO_2$ refrigerant staying inside the heat exchanger repeats a two-phase change of a gaseous form and reliquefaction;

an opening/closing valve that is closed during the defrosting and that sets the $CO_2$ circulation path to a closed circuit in which the $CO_2$ refrigerant is naturally circulated during the defrosting;

the thermosiphon defrost circuit including:

a first line branching from the circulation line of the $CO_2$ refrigerant;

a first header to which an end of the first line is connected, the first header to which the end of the first line is connected including first and second parts that are spaced apart from one another, the first line providing communication between the first header of the thermosiphon defrost circuit and the lower header of the heat exchanger so that the $CO_2$ refrigerant that has entered the lower header after flowing through the plural heat exchange tubes flows toward the first header;

a second header provided at a position higher than the first header, the second header including first and second parts that are spaced apart from one another;

the first part of the first header and the first part of the second header being closest parts of the first and second headers, the second part of the first header and the second part of the second header being most distant parts of the first and second headers, a straight line distance between the closest parts of the first and second headers being less than a straight line distance between the most distant parts of the first and second headers;

plural second lines that extend between and communicate the first and second headers, the plural second lines including a line connecting the most distant parts of the first header and the second header in a meander shape, and a line connecting the closest parts of the first header and the second header in a meander shape;

a third line that provides communication between the second header of the thermosiphon defrost circuit and the upper header of the heat exchanger; and an electric heater positioned inside the cold storage room and outside the casing, the electric heater being positioned above all of the second lines that extend between and communicate the first and second headers, the electric heater being configured to heat and vaporize the $CO_2$ refrigerant liquid in the second lines during the defrosting and without a brine circuit so that the $CO_2$ refrigerant liquid that is vaporized rises in the thermosiphon defrost circuit by the principle of thermosiphon.

11. The refrigeration apparatus according to claim 10, comprising:

a pressure sensor that measures a pressure of the $CO_2$ circulation path during the defrosting; and a control portion that controls the electric heater to decrease a pressure in the $CO_2$ circulation path when a pressure measured by the pressure sensor is higher than a predetermined pressure.

12. The refrigeration apparatus according to claim 10, wherein the electric heater is a first electric heater, and further comprising a second electric heater positioned in the casing at a lower part of the casing.

13. The refrigeration apparatus according to claim 10, further comprising a branch circuit that branches from the circulation line, and a pressure adjusting valve located in the branch circuit to reduce pressure when the pressure in the circulation line is higher than a predetermined pressure.

14. The refrigeration apparatus according to claim 10, further comprising heat insulating material positioned below the plural second lines that extend between and communicate the first and second headers so that the plural second lines are positioned between the heat insulating material and the electric heater.

15. The refrigeration apparatus according to claim 14, wherein the electric heater is positioned between the drain pan and the plural second lines that extend between and communicate the first and second headers.

16. The refrigeration apparatus according to claim 15, wherein the electric heater is a first electric heater, and further comprising a second electric heater positioned in the casing at a lower part of the casing, the second electric heater being located above the first electric heater.

17. The refrigeration apparatus according to claim 16, further comprising a heat transfer plate positioned between the first electric heater and the plural second lines that extend between and communicate the first and second headers to transfer heat produced by the first electric heater to the $CO_2$ refrigerant in the plural second lines.

18. The refrigeration apparatus according to claim 10, further comprising a heat transfer plate positioned between the electric heater and the plural second lines that extend between and communicate the first and second headers to transfer heat produced by the electric heater to the $CO_2$ refrigerant in the plural second lines.

* * * * *